United States Patent [19]

Watanabe

[11] Patent Number: 4,913,118

[45] Date of Patent: Apr. 3, 1990

[54] FUEL INJECTION CONTROL SYSTEM FOR AN AUTOMOTIVE ENGINE

[75] Inventor: Hideo Watanabe, Tokyo, Japan

[73] Assignee: Fuji Jukogyo Kabushiki Kaisha, Tokyo, Japan

[21] Appl. No.: 330,592

[22] Filed: Mar. 28, 1989

[30] Foreign Application Priority Data

Apr. 1, 1988 [JP] Japan ..... 63-81803

[51] Int. Cl.[4] ..... F02D 41/18

[52] U.S. Cl. ..... 123/435; 123/489; 73/117.3

[58] Field of Search ..... 123/435, 489; 73/117.3

[56] References Cited

FOREIGN PATENT DOCUMENTS

| | | | |
|---|---|---|---|
| 59-103965 | 6/1984 | Japan | 123/435 |
| 60-47836 | 3/1985 | Japan . | |
| 63-75325 | 4/1988 | Japan | 123/435 |
| 63-75326 | 4/1988 | Japan | 123/435 |

*Primary Examiner*—Andrew M. Dolinar

*Attorney, Agent, or Firm*—Martin A. Faber

[57] ABSTRACT

A fuel injection control system has a pressure sensor for sensing pressure in each cylinder of an engine, a temperature sensor for sensing temperature of a cylinder of the engine. A quantity of intake air at a predetermined crank angle is calculated based on the detected pressure and temperature. A fuel injection pulse width is calculated based on the calculated quantity of intake air.

3 Claims, 4 Drawing Sheets

FUEL INJECTION CONTROL SYSTEM FOR AN AUTOMOTIVE ENGINE

BACKGROUND OF THE INVENTION

The present invention relates to a system for controlling the fuel injection of an automotive engine in dependency on pressure and temperature in cylinders of the engine. The pressure in the cylinders is used as a parameter representing quantity of intake air, for deciding air-fuel ratio of mixture.

Recently, there has been proposed a system for accurately controlling the ignition timing and the air-fuel ratio by detecting combustion pressure in each cylinder of the engine with a pressure sensor. Japanese Patent Application Laid-Open No. 60-47836 discloses a system for controlling the air-fuel ratio based on pressure in cylinders. In the system, a fuel injection pulse width is derived from a basic fuel injection pulse width table in accordance with detected pressure and engine speed.

However, the pressure in the cylinder is closely related with temperature in a combustion chamber. The temperature changes in accordance with temperature of the wall of the combustion chamber, which changes with coolant temperature, and ambient temperature. Accordingly, it is difficult to estimate the air quantity in dependency only on pressure in the cylinder. Further, in a multiple cylinder engine, the temperature of the wall of the combustion chamber differs at every cylinder due to the disposition of a coolant passage. Consequently, in the fuel injection control system, the air-fuel ratios in cylinders are different. As a result, combustion of the fuel becomes unstable, causing aggravation of fuel consumption and emission control.

On the other hand, the intake air quantity in each cylinder cannot be measured with a conventional air-flow meter. Accordingly, the air-fuel ratio for each cylinder cannot be controlled by the system employing the air-flow meter. In addition, the air-flow meter becomes a resistance to air, resulting in reduction of intake efficiency.

SUMMARY OF THE INVENTION

The object of the present invention is to provide a system for controlling the fuel injection where quantity of intake air is precisely controlled so that the air-fuel ratio can be accurately controlled.

According to the present invention, there is provided a system for controlling fuel injection for an automotive engine having at least one fuel injector, comprising a pressure sensor for sensing pressure in each cylinder of the engine and for producing a pressure signal, a temperature sensor for sensing temperature of a cylinder of the engine and for producing a temperature signal, a timing sensor for sensing a predetermined crank angle with respect to each cylinder and for producing a timing signal at the crank angle, first calculator means responsive to the pressure signal, the temperature signal and the timing signal for calculating quantity of intake air at the time of the timing signal, second calculator means for calculating a fuel injection pulse width based on the calculated quantity of intake air, and driver means for actuating the fuel injector in accordance with the fuel injection pulse width.

In an aspect of the invention, the temperature sensor is provided for each cylinder.

The system further comprises an $O_2$-sensor for producing a feedback signal representing air-fuel ratio of mixture supplied to cylinders of the engine, and correcting means for correcting the fuel injection pulse width in accordance with the feedback signal.

The other objects and features of this invention will become understood from the following description with reference to the accompanying drawings.

DETAILED DESCRIPTION OF THE PREFERRED EMBODIMENT

Figure 1:
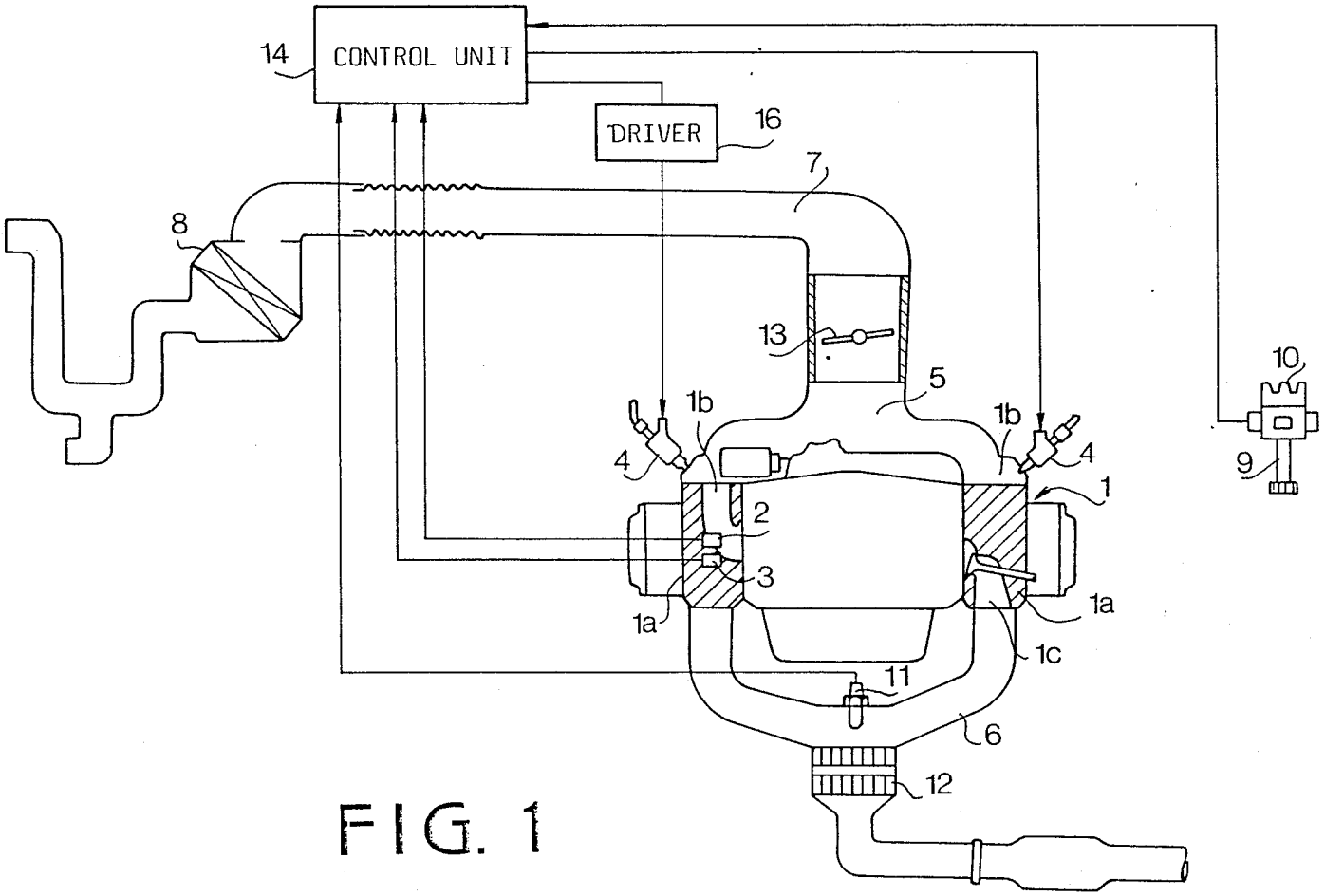
FIG. 1 is a schematic diagram showing a fuel injection control system according to the present invention.

Referring to FIG. 1, a horizontally opposed four-cylinder internal combustion engine 1 for a motor vehicle is supplied with air through an air cleaner 8, an intake pipe 7, a throttle valve 13 and an intake manifold 5, mixing with fuel injected from injectors 4. The injector 4 is disposed in an intake port **1*b* which communicates with a cylinder of the engine 1. Exhaust gas of the engine 1 is discharged passing through exhaust ports 1*c*, an exhaust manifold 6 and a catalytic converter 12**.

A pressure sensor 2 and a temperature sensor 3 for respectively detecting pressure and temperature in a combustion chamber of each cylinder are provided in a cylinder head la of each bank of the engine 1. The temperature sensor 3 is, for example, a heat-sensitive temperature sensor which detects the temperature in dependency on a change in resistance of a thermister provided therein. Furthermore, an $O_2$-sensor 11 is mounted in the exhaust manifold 6. A distributor 9 connected to a crankshaft (not shown) of the engine 1 has a timing sensor 10. The timing sensor 10 has a timing rotor (not shown) securely mounted on a distributor shaft of the distributor 9 so as to detect a timing of each cylinder when the crankshaft is at a predetermined crank angle during the compression stroke of the cylinder. For example, the predetermined crank angle is before top dead center (BTDC) 90°, where the pressure begins to largely change before ignition.

Output signals of the sensors 2, 3, 10 and 11 are applied to a control unit 14. The control unit 14 produces an actuating signal to operate the injectors 4 through a driver 16.

Figure 2:
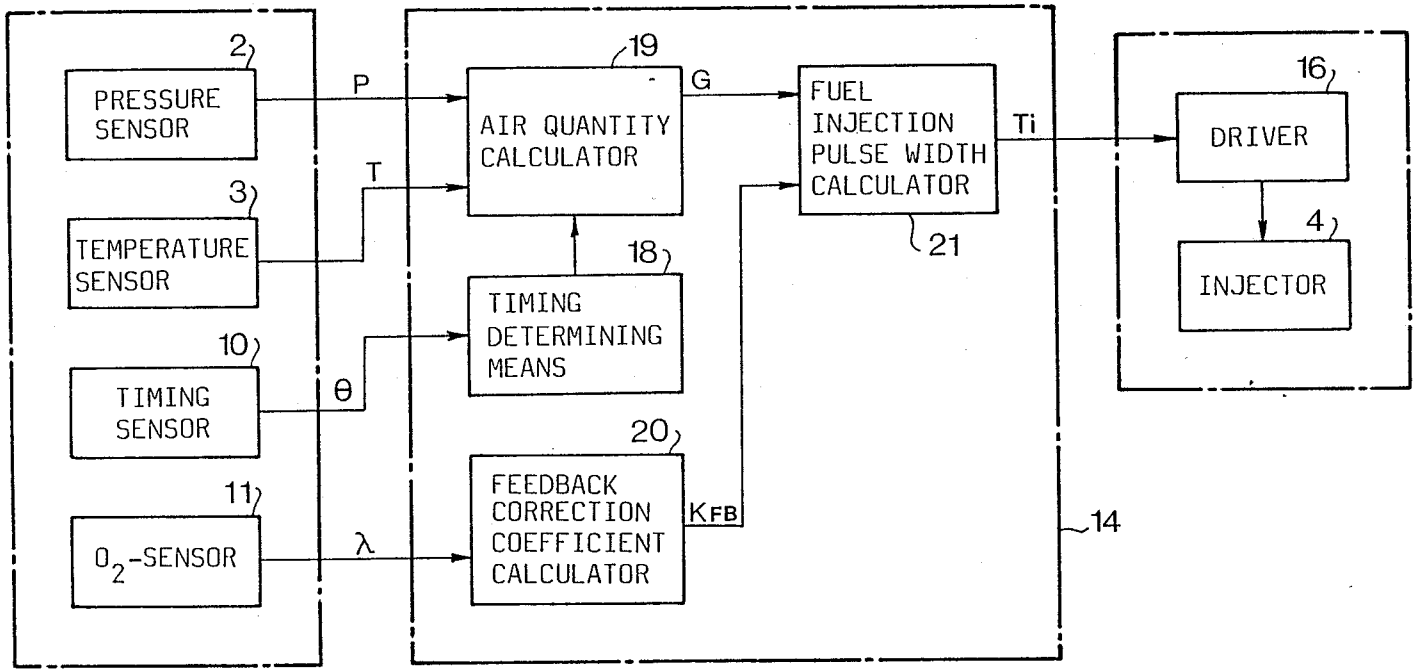
FIG. 2 is a block diagram showing a control unit of the present invention.

Referring to FIG. 2, the control unit 14 comprises a timing determining means 18 to which an output signal of the timing sensor 10 is fed. When a crank angle $\theta$ is at the predetermined angle BTDC 90°, the timing determining means 18 applies an output signal to an air quantity calculator 19 to which output signals of the pressure sensor 2 and the temperature sensor 3 are also applied. In the air quantity calculator 19, quantity G of intake air in each cylinder is calculated based on Boyle-Charles' law as follows.

$$P \times V = G \times R \times T$$

where

P: the pressure in a combustion chamber

T: the temperature in the combustion chamber

V: a fixed volume at the predetermined crank angle
R: a gas constant during compression stoke $$\therefore G=(P\times V)/(R\times T) \quad (1)$$

The control unit 14 further has a feedback correction coefficient calculator 20 for calculating a feedback correction coefficient $K_{FB}$ based on an output signal λ of the $O_2$-sensor 11. The intake air quantity G and the correction coefficient $K_{FB}$ are applied to a fuel injection pulse width calculator 21 where a fuel injection pulse width Ti is calculated in accordance with the following equation.

$$Ti=K\times G\times K_{FB} \text{ (K is a constant)} \quad (2)$$

The pulse width Ti is applied to the injectors 4 through the driver 16 for injecting the fuel. The pulse width Ti is independently obtained for each cylinder in accordance with the timing signal from the timing detecting means 18.

Figure 4:
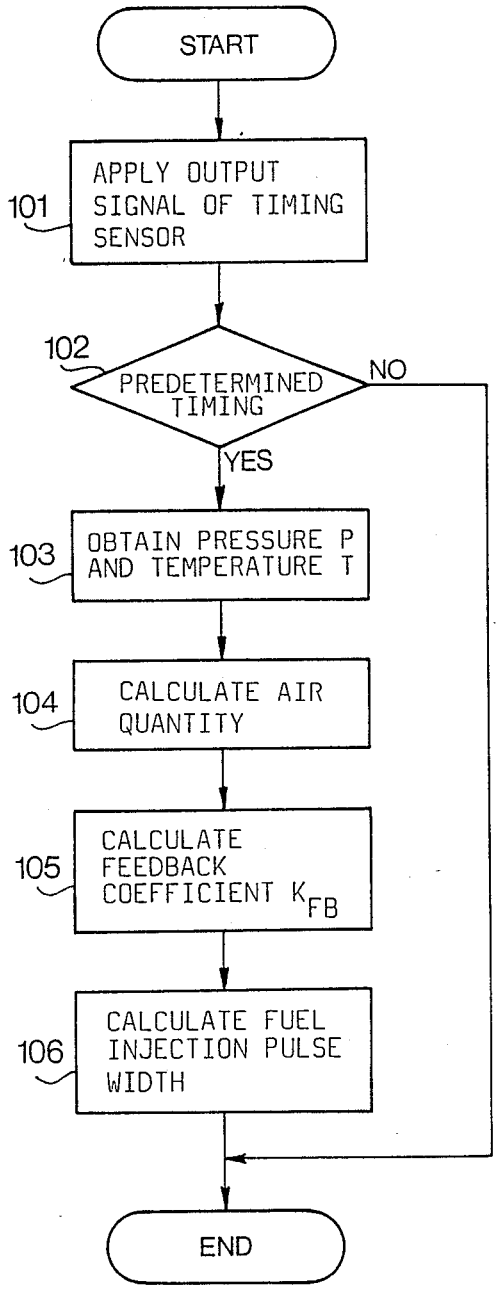
FIG. 4 is a flowchart showing the operation of the system of the present invention.

The operation of the present invention is described hereinafter with reference to the flowchart of FIG. 4.

At a step 101, the output signal of timing sensor 10 is applied to the timing determining means 18 of control unit 14. At a step 102, it is determined whether the crank angle is at the predetermined angle, for example BTDC 90°, that is, at a proper measurement timing. When the crank angle is at the predetermined angle, the program proceeds to a step 103. Otherwise, the program is terminated. At the step 103, the pressure P and the temperature T in the particular combustion chamber detected by the sensor 2 and 3 are calculated. At a step 104, the intake air quantity G is calculated dependent on the afore-described equation (1), based on the pressure P and the temperature T. The feedback coefficient $K_{FB}$ is calculated in accordance with the output signal λ of the $O_2$ sensor 11 at a step 105. At a step 106, the fuel injection pulse width Ti is obtained in dependency on the equation (2).

Figure 3:
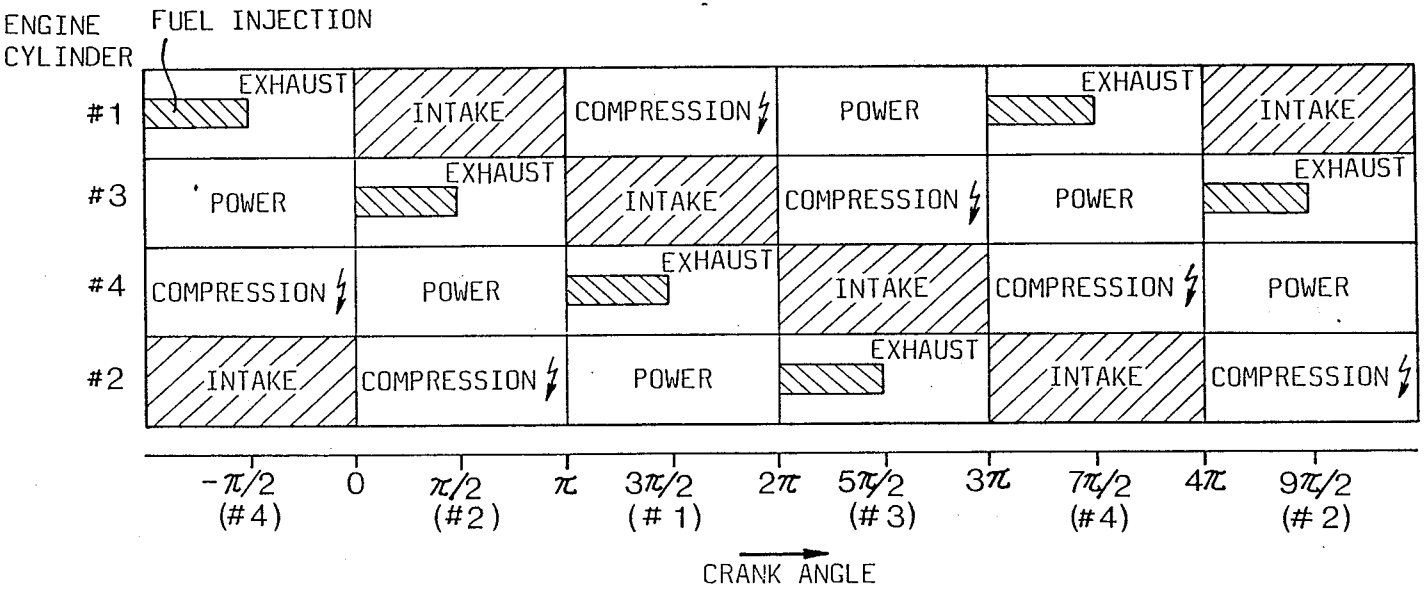
FIG. 3 is a diagram showing operating cycles in cylinders of an automotive engine with respect to crank angle.

The fuel injection pulse width for each cylinder is calculated at each of the predetermined crank angle so as to inject fuel during the exhaust stroke as shown in FIG. 3.

The present invention may be modified so as to provide the temperature sensor 3 in only one f the cylinders. The temperature T detected by the single sensor 3 is stored in a memory and the latest detected temperature is derived from the memory when calculating the fuel injection pulse width for other cylinders.

From the foregoing, it will be understood that the present invention provides a system for controlling the fuel injection, where intake air quantity in each cylinder is accurately calculated based on the pressure and the temperature in the cylinder, so that uniform air-fuel ratio can be obtained in all cylinders. As a result, a stable engine operation can be obtained, thereby improving emission control and fuel consumption.

While the presently preferred embodiment of the present invention has been shown and described, it is to be understood that this disclosure is for the purpose of illustration and that various changes and modifications may be made without departing from the scope of the invention as set forth in the appended claims.

What is claimed is:

1. A system for controlling fuel injection for an automotive engine having at least one fuel injector, comprising:

a pressure sensor for sensing pressure in each cylinder of said engine and for producing a pressure signal;

a temperature sensor for sensing temperature of a cylinder of said engine and for producing a temperature signal;

a timing sensor for sensing a predetermined crank angle with respect to each cylinder and for producing a timing signal at the crank angle;

first calculator means responsive to the pressure signal, the temperature signal and the timing signal for calculating quantity of intake air at the time of the timing signal;

second calculator means for calculating a fuel injection pulse width based on the calculated quantity of intake air; and driver means for actuating said fuel injector in accordance with said fuel injection pulse width.

2. The system according to claim 1 wherein said temperature sensor is provided for each cylinder.

3. The system according to claim 1 further comprising an $O_2$-sensor for producing a feedback signal representing air-fuel ratio of mixture supplied to cylinders of said engine, and correcting means for correcting the fuel injection pulse width in accordance with the feedback signal.

* * * * *